US007836817B2

(12) United States Patent
Tokumoto

(10) Patent No.: US 7,836,817 B2
(45) Date of Patent: Nov. 23, 2010

(54) FLUID PRESSURE CYLINDER

(75) Inventor: Shioto Tokumoto, Moriya (JP)

(73) Assignee: SMC Kabushiki Kaisha, Tokyo (JP)

( * ) Notice: Subject to any disclaimer, the term of this patent is extended or adjusted under 35 U.S.C. 154(b) by 427 days.

(21) Appl. No.: 11/950,369

(22) Filed: Dec. 4, 2007

(65) Prior Publication Data

US 2008/0134881 A1 Jun. 12, 2008

(30) Foreign Application Priority Data

Dec. 6, 2006 (JP) ..... 2006-329537

(51) Int. Cl.
*F16J 10/02* (2006.01)
*F16J 1/00* (2006.01)

(52) U.S. Cl. ..... 92/169.1; 92/177

(58) Field of Classification Search ..... 92/165 PR, 92/169.1, 171.1, 177
See application file for complete search history.

(56) References Cited

U.S. PATENT DOCUMENTS

| | | | | |
|---|---|---|---|---|
| 2,983,256 | A | 5/1961 | Seeloff | |
| 3,605,915 | A | 9/1971 | Gately et al. | |
| 3,643,551 | A | 2/1972 | Berg | |
| 3,913,460 | A | 10/1975 | Wright | |
| 3,961,564 | A | 6/1976 | Rich et al. | |
| 4,050,285 | A | 9/1977 | Bosch et al. | |
| 4,896,584 | A | 1/1990 | Stoll et al. | |
| 4,928,577 | A | 5/1990 | Stoll | |
| 4,977,760 | A * | 12/1990 | Ishimori et al. | 92/169.1 |
| 4,982,652 | A * | 1/1991 | Blatt | 92/169.1 |
| 5,241,896 | A | 9/1993 | Braun et al. | |
| 5,456,161 | A * | 10/1995 | Yuda et al. | 92/169.1 |
| 5,669,284 | A * | 9/1997 | Fish | 92/169.1 |
| 5,701,800 | A | 12/1997 | Kaup | |
| 5,850,776 | A | 12/1998 | Takeuchi et al. | |
| 6,186,484 | B1 | 2/2001 | Noda et al. | |
| 6,502,880 | B1 | 1/2003 | Sawdon | |
| 6,526,870 | B2 | 3/2003 | Takanashi et al. | |
| 6,761,105 | B2 * | 7/2004 | Keaton | 92/169.1 |

FOREIGN PATENT DOCUMENTS

| | | |
|---|---|---|
| CN | 1080395 | 3/2002 |
| CN | 2694022 | 4/2005 |
| DE | 196 02 553 A1 | 7/1997 |
| DE | 299 16 190 U1 | 12/1999 |
| EP | 1489311 | 12/2004 |
| JP | 05-231407 | 9/1993 |
| JP | 07-010534 | 2/1995 |
| JP | 07-34239 | 6/1995 |
| JP | 3023136 | 4/1996 |
| JP | 09-303320 | 11/1997 |
| JP | 10-009213 | 1/1998 |

(Continued)

*Primary Examiner*—Michael Leslie
(74) *Attorney, Agent, or Firm*—Paul A. Guss

(57) ABSTRACT

A pair of recesses is formed on a cylinder hole of a cylinder tube, wherein the recesses are recessed further into the cylinder hole from an inner circumferential surface thereof. Projections that correspond to the recesses are disposed on a head cover and a rod cover, respectively, which are installed into both ends of the cylinder tube. The head cover and the rod cover that are accommodated in the cylinder hole are positioned through abutment of the projections against stepped portions of the recesses.

8 Claims, 12 Drawing Sheets

FOREIGN PATENT DOCUMENTS

| | | |
|---|---|---|
| JP | 10-318213 | 12/1998 |
| JP | 11-311210 | 11/1999 |
| JP | 2000-088028 | 3/2000 |
| JP | 2003-88937 | 3/2003 |
| JP | 2005-320994 | 11/2005 |
| SU | 526726 | 8/1976 |
| SU | 1390449 | 4/1988 |

* cited by examiner

FLUID PRESSURE CYLINDER

BACKGROUND OF THE INVENTION

1. Field of the Invention

The present invention relates to a fluid pressure cylinder in which a piston is displaced along an axial direction under the supply of a pressure fluid.

2. Description of the Related Art

Heretofore, a fluid pressure cylinder, having a piston therein displaced under the supply of a pressure fluid, has been used, for example, as a transport device for transporting various workpieces and the like.

In such a fluid pressure cylinder, a construction is provided in which a piston is disposed displaceably inside of a cylinder chamber, which is defined at the interior of a tubular cylinder body, and a head cover and a rod cover are installed respectively on both ends of the cylinder body, thereby closing the cylinder chamber.

Such a fluid pressure cylinder, for example as disclosed in Japanese Laid-Open Patent Publication No. 09-303320, employs a piston, which is elliptically shaped in cross section with the major axis thereof aligned in the horizontal direction. By employing an elliptically shaped cylinder chamber as well, it is known to provide a cylinder body, having the piston installed therein, which is thin-shaped and low in profile. Further, in the fluid pressure cylinder, a head cover and a rod cover are fixed onto both ends of the cylinder body by a plurality of bolts, and gaskets are sandwiched between the head and rod covers and the cylinder body. The gaskets are formed with substantially elliptical shapes in cross section, corresponding to the cross sectional shape of the piston hole. In addition, portions of the gaskets are accommodated within the piston hole and abut against an inner circumferential surface of the piston hole, such that the gaskets maintain an airtight state between the head and rod covers and the cylinder body.

Incidentally, in the conventional technique disclosed by Japanese Laid-Open Patent Publication No. 09-303320, it is essential to perform processing on the outer circumferential surfaces of the gaskets, which abut against the piston hole. Notwithstanding, since the outer circumferential surfaces of the gaskets are formed with elliptical cross sectional shapes, a heavy processing cost is required when such processing is implemented along the entire surface thereof. As a result, manufacturing costs for the fluid pressure cylinder are steeply increased.

Further, in the conventional technique according to Japanese Laid-Open Patent Publication No. 09-303320, because a structure is used in which the head cover and the rod cover are fixed with respect to both ends of the cylinder body by a plurality of bolts, the longitudinal dimension of the fluid pressure cylinder is increased by the width of the head cover and the rod cover, thereby increasing the size of the fluid pressure cylinder.

SUMMARY OF THE INVENTION

A general object of the present invention is to provide a fluid pressure cylinder, which enables a reduction in manufacturing costs, along with minimizing the size of the fluid pressure cylinder.

The above and other objects features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
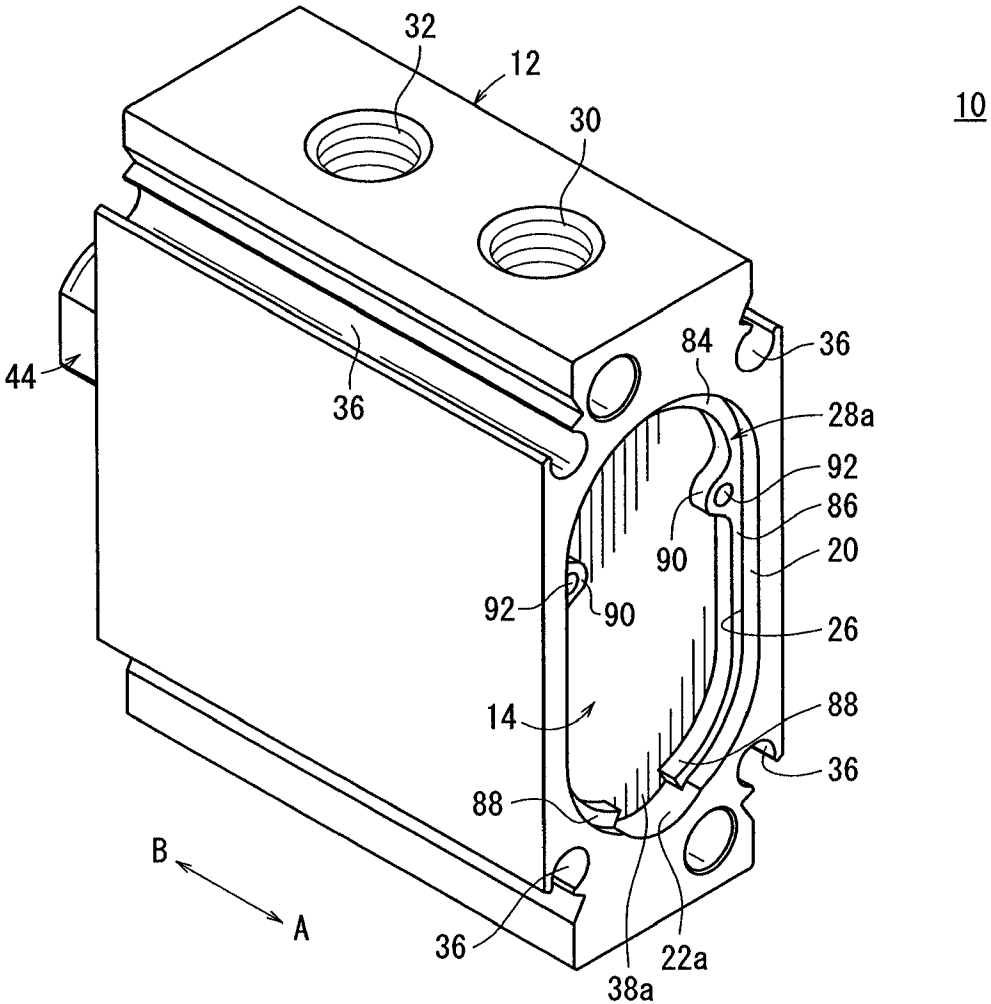
FIG. 1 is an exterior perspective view of a fluid pressure cylinder according to an embodiment of the present invention.
Figure 2:
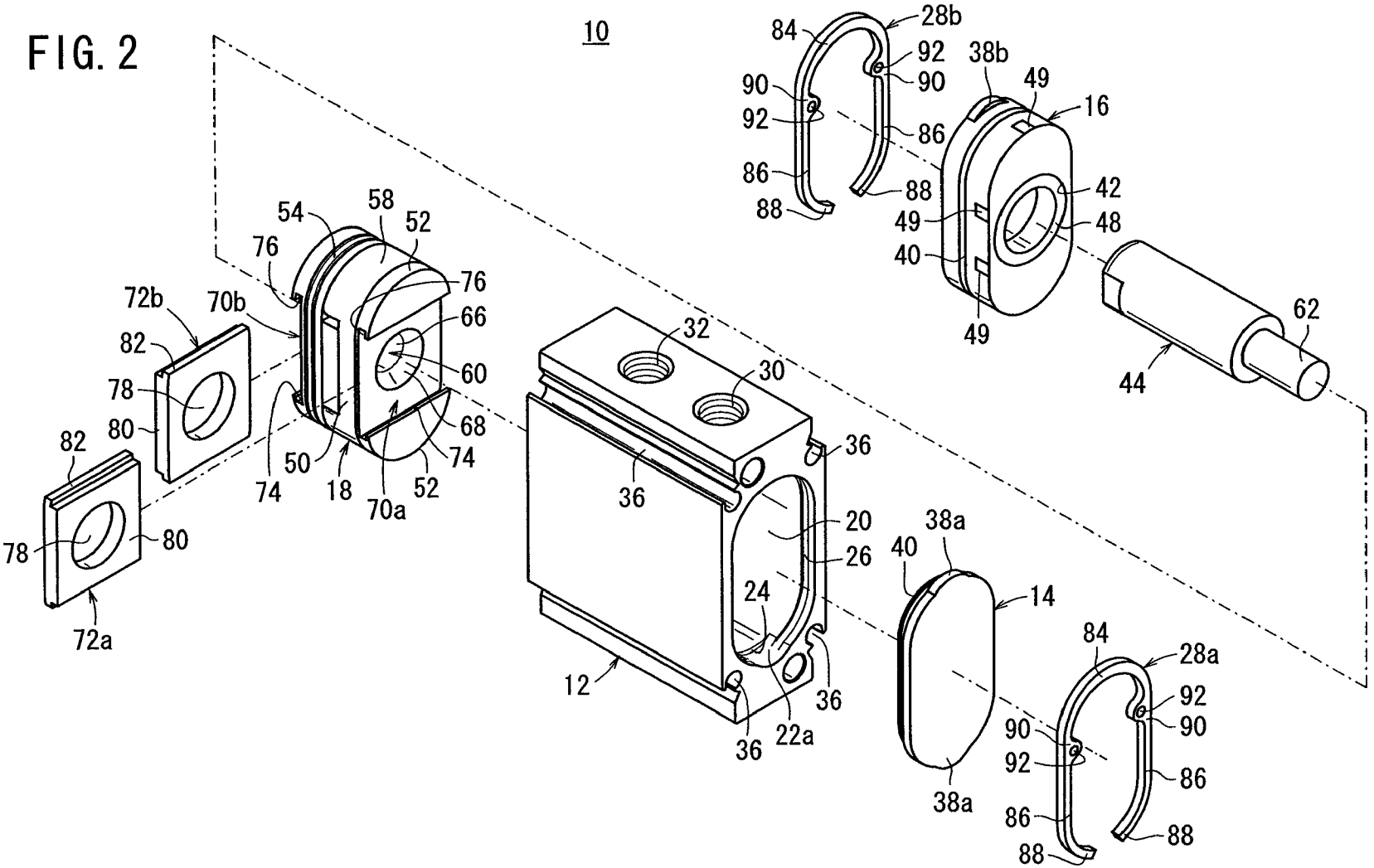
FIG. 2 is an exploded perspective view of the fluid pressure cylinder shown in FIG. 1.
Figure 3:
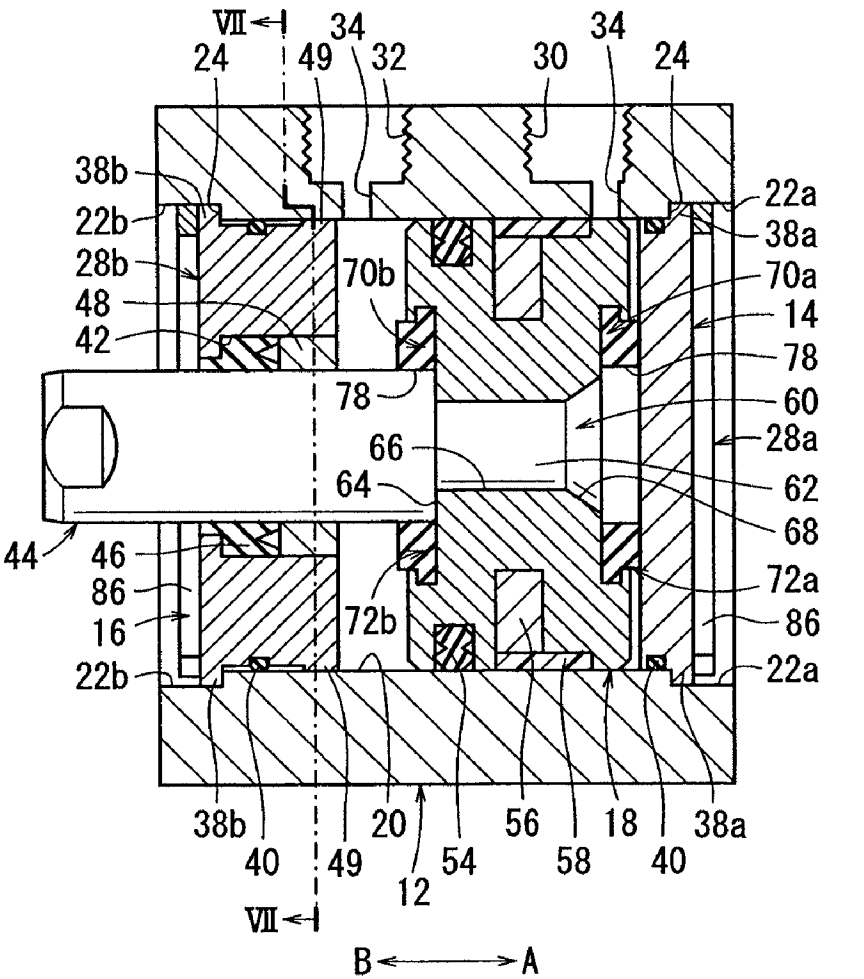
FIG. 3 is an overall vertical cross sectional view of the fluid pressure cylinder shown in FIG. 1.
Figure 4:
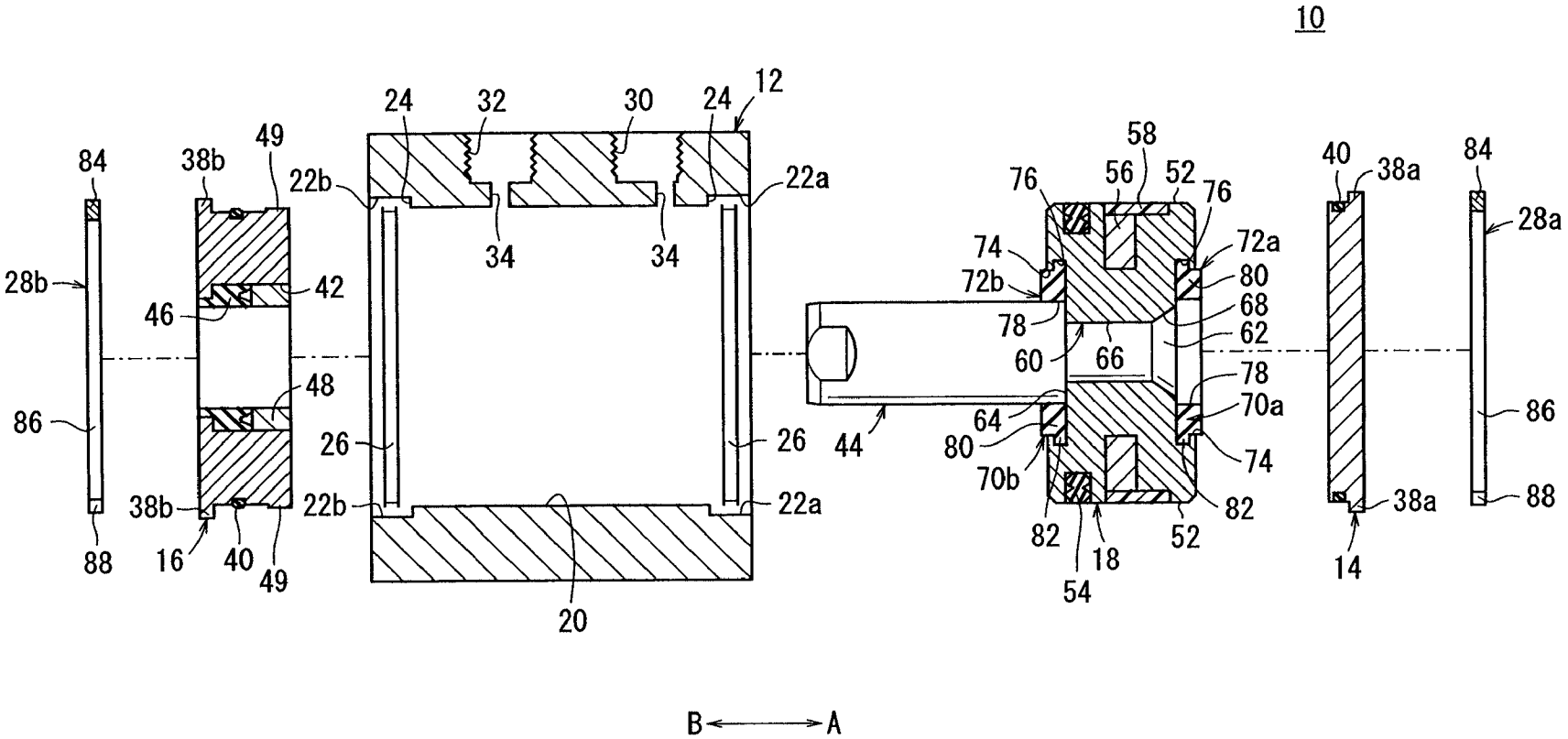
FIG. 4 is an exploded vertical cross sectional view of the fluid pressure cylinder shown in FIG. 3.

In FIG. 1, reference numeral 10 indicates a fluid pressure cylinder according to an embodiment of the present invention.

As shown in FIGS. 1 to 4, the fluid pressure cylinder 10 includes a tubular shaped cylinder tube (cylinder body) 12, a head cover (cover member) 14 installed on one end of the cylinder tube 12, a rod cover (cover member) 16 installed on the other end of the cylinder tube 12, and a piston 18 disposed displaceably inside the cylinder tube 12.

Figure 5:
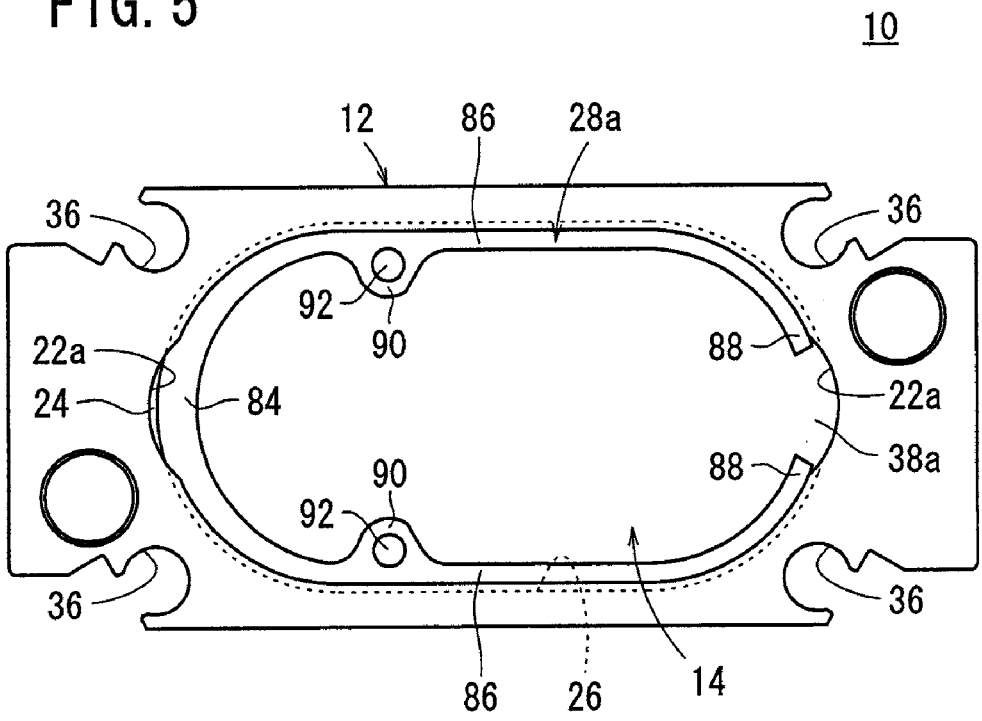
FIG. 5 is a side surface view, as viewed from a head cover side of the fluid pressure cylinder shown in FIG. 1.
Figure 6:
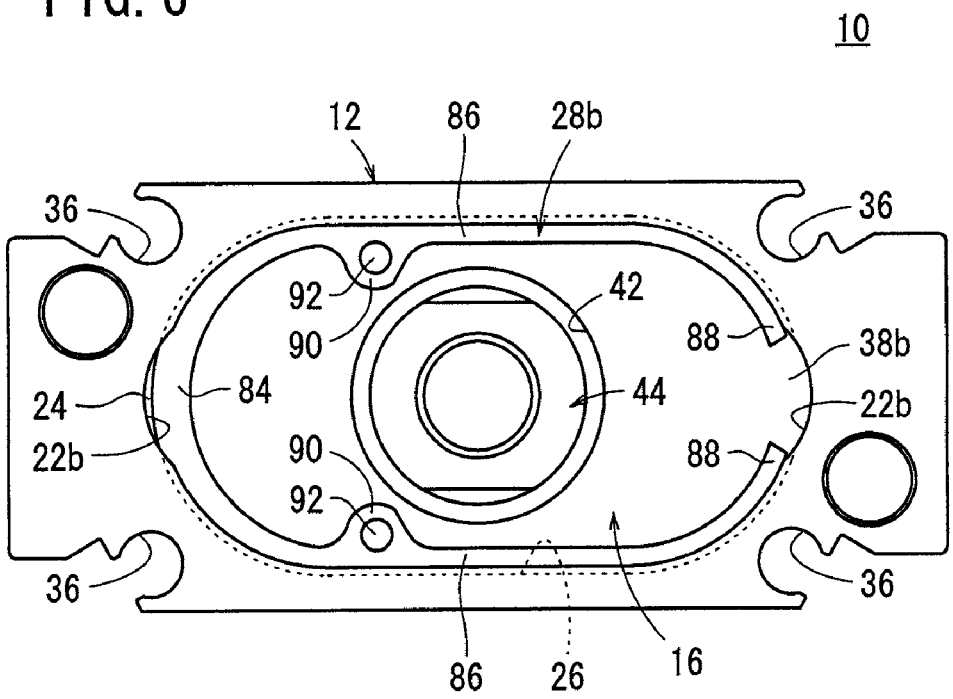
FIG. 6 is a side surface view, as viewed from a rod cover side of the fluid pressure cylinder shown in FIG. 1.
Figure 7:
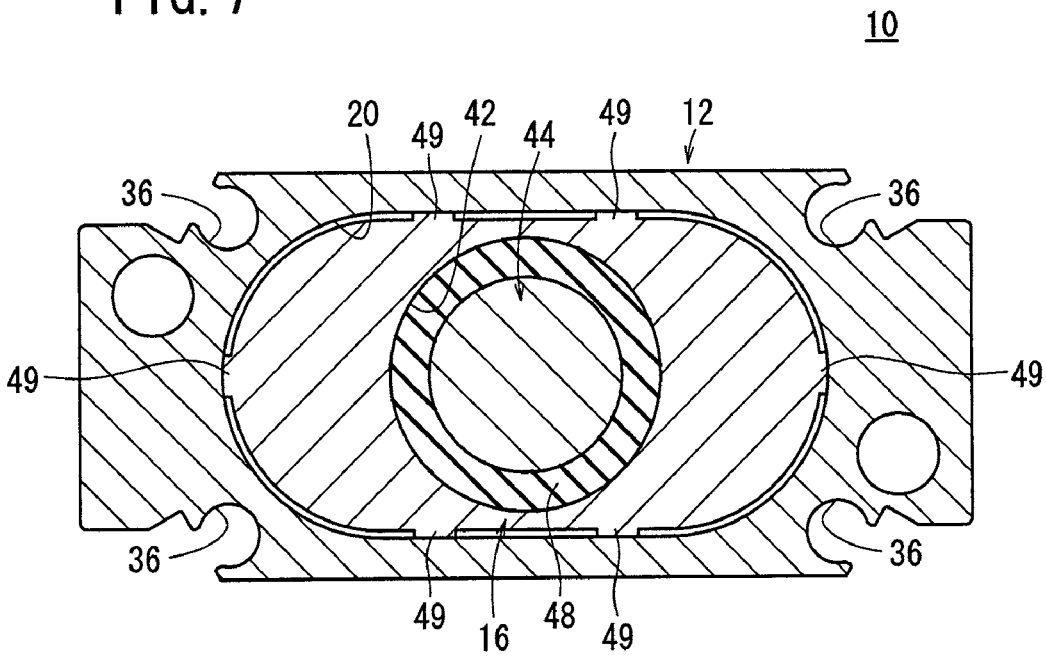
FIG. 7 is a cross sectional view taken along line VII-VII in FIG. 3.

The cylinder tube 12 is constructed with a substantially rectangular shape in cross section, having a cylinder hole (cylinder chamber) 20, which is substantially elliptically shaped in cross section, penetrating in the axial direction inside the cylinder tube 12. The cylinder hole 20 is formed so as to be substantially elliptically shaped in cross section such that the major axis thereof lies substantially in the horizontal direction (when the fluid pressure cylinder 10 is oriented as shown in FIGS. 5 to 7), and wherein on both ends thereof, a pair of recesses 22*a*, 22*b* are provided, which are expanded in width in directions away from the center of the cylinder hole 20.

The pairs of recesses 22*a*, 22*b* are formed respectively on both end portions, such that the recesses 22*a*, 22*b* are recessed in arcuate shapes and lie substantially in a horizontal direction with respect to the flat-shaped cylinder tube 12. More specifically, the recesses 22*a*, 22*b* are arranged facing each other, while being arcuately recessed in directions away from the center of the cylinder hole 20. The radius of curvature of the recesses 22*a*, 22*b* is set to be smaller than the radius of curvature on both end portions of the cylinder hole 20.

Specifically, the inner circumferential surface of the cylinder hole 20 is formed such that both end portions of the cylinder hole 20 are made larger only at the portions of the recesses 22*a*, 22*b*. Further, stepped portions 24 are disposed between the recesses 22*a*, 22*b* and a central region along the axial direction of the cylinder hole 20.

Further, ring grooves (installation grooves) 26 are formed respectively on both ends of the cylinder hole 20 along the inner circumferential surface thereof while facing the recesses 22*a*, 22*b*. Locking rings (locking members) 28*a*, 28*b* are installed respectively into the ring grooves 26.

On the other hand, a pair of first and second fluid ports 30, 32 through which a pressure fluid is supplied and discharged is formed on an outer side surface of the cylinder tube 12. The first and second fluid ports 30, 32 are separated a predetermined distance along the axial direction of the cylinder tube 12, and communicate respectively with the cylinder hole 20 through communication passages 34 (see FIG. 3). Accordingly, the pressure fluid supplied to the first and second fluid ports 30, 32 passes through the communication passages 34 and is introduced to the interior of the cylinder hole 20. Further, a plurality of sensor grooves 36, in which sensors may be installed that are capable of detecting the position of the piston 18, extend along the axial direction (in the direction of the arrows A and B) on the outer side surface of the cylinder tube 12.

The head cover 14 is formed with a substantially elliptical shape in cross section corresponding to the shape of the cylinder hole 20, and is installed in one end side (in the direction of the arrow A) of the cylinder tube 12. A pair of projections (first projections) 38*a* are formed, which project a given length from the outer circumferential surface thereof on both side portions corresponding to the recesses 22*a* of the cylinder hole 20. The projections 38*a* are disposed on both side portions of the head cover 14, bulging outwardly with arcuate shapes and with a predetermined radius of curvature corresponding to that of the recesses 22*a* (see FIG. 5).

Further, an o-ring 40 is installed in an annular groove on the outer circumferential surface of the head cover 14. When the head cover 14 is installed in the cylinder hole 20 of the cylinder tube 12, an airtight condition is maintained by abutment of the o-ring 40 against the inner circumferential surface of the cylinder hole 20.

Similar to the head cover 14, the rod cover 16 is formed with a substantially elliptical shape in cross section corresponding to the shape of the cylinder hole 20, and is installed in the other end side (in the direction of the arrow B) of the cylinder tube 12. In addition, a pair of projections (first projections) 38*b* are formed, which project a given length from the outer circumferential surface thereof on both side portions corresponding to the recesses 22*b* of the cylinder hole 20. The projections 38*b* are disposed on both side portions of the rod cover 16, bulging outwardly with arcuate shapes, and with a predetermined radius of curvature corresponding to that of the recesses 22*b* (see FIG. 6).

Further, a rod hole 42, which penetrates along the axial direction, is formed at a substantially central portion of the rod cover 16, and a piston rod 44 connected to the piston 18 is inserted through the rod hole 42. A rod packing 46 and a bush 48 are installed on an inside portion of the rod hole 42, thereby maintaining an airtight condition at the interior of the cylinder hole 20.

Furthermore, an o-ring 40 is installed on the outer circumferential surface of the rod cover 16, in an annular groove at a substantially central portion in the axial direction of the rod cover 16. A plurality (for example, six) guide members (second projections) 49, which are separated by predetermined distances, are disposed on an end portion symmetrical with the projections 38*b* while sandwiching the annular groove therebetween (see FIG. 7). The guide members 49 project at a given height with respect to the outer circumferential surface, such that when the rod cover 16 is inserted into the cylinder hole 20, the guide members 49 slidably contact the inner circumferential surface of the cylinder hole 20. That is, the guide members 49 are formed with shapes that correspond to the inner circumferential surface of the cylinder hole 20. The quantity of guide members 49 is not restricted to any particular number, so long as it is equal to or greater than four, and the guide members 49 are separated mutually from each other at predetermined distances.

Owing thereto, when the rod cover 16 is inserted into the cylinder hole 20, the rod cover 16 is guided with respect to the cylinder hole 20 by the plurality of guide members 49, and the rod cover 16 is properly positioned radially within the cylinder hole 20. As a result, the center of the cylinder hole 20 and the axial line of the rod cover 16 can be made to coincide with each other, and the piston rod 44, which is inserted through the cylinder hole 20, can be inserted with respect to the rod hole 42 of the rod cover 16 and pass therethrough accurately and with high precision.

Further, when the rod cover 16 is installed in the cylinder hole 20 of the cylinder tube 12, an airtight condition is maintained by abutment of the o-ring 40 against the inner circumferential surface of the cylinder hole 20.

The piston 18 is formed with a substantially elliptical shape in cross section. A pair of planar surface sections 50 are provided on the outer circumferential surface of the piston 18, and a pair of arcuate sections 52, which expand outwardly on outer sides with a given radius of curvature, are connected to both end portions of the planar surface sections 50. A piston packing 54 and a magnetic body 56 are installed on the outer circumferential surface, and the magnetic body 56 is covered by a piston cover 58. An outer circumferential surface of the piston cover 58 lies substantially on the same surface as the outer circumferential surface of the piston 18.

Further, a piston hole 60 that penetrates in the axial direction (in the direction of the arrows A and B) is formed on an inner portion of the piston 18, and a connecting portion 62 of the piston rod 44 is inserted through the piston hole 60. The piston hole 60 includes a first hole 64 which is opened toward the side of the rod cover 16 (in the direction of the arrow B), a second hole 66 adjacent to the first hole 64 and which is reduced in diameter, and a tapered hole 68 adjacent to the second hole 66 and which gradually expands in diameter toward the side of the head cover 14 (in the direction of the arrow A). The first and second holes 64, 66 and the tapered hole 68 are mutually connected with one another.

On the other hand, on both end surfaces of the piston 18, a pair of damper grooves 70*a*, 70*b* is formed, the damper grooves 70*a*, 70*b* being recessed at a given depth. Cushion dampers 72*a*, 72*b* are installed respectively into each of the damper grooves 70*a*, 70*b*.

The damper grooves 70*a*, 70*b* extend substantially perpendicular to the axis of the piston 18 along both end surfaces, penetrating between the pair of planar surface sections 50. In addition, the damper grooves 70*a*, 70*b* include first grooves 74 that are formed adjacent to both end surfaces of the piston 18, and second grooves 76, which are recessed further inwardly from both end surfaces than the first grooves 74, and which are expanded in width with respect to the first grooves 74. The second grooves 76 are expanded in width by a predetermined width, in directions substantially perpendicular to the direction in which the damper grooves 70*a*, 70*b* extend.

The cushion dampers 72*a*, 72*b* are substantially rectangular plate shaped bodies in cross section, formed from an elastic material such as urethane rubber or the like, for example, and are disposed respectively so as to project a predetermined length outwardly from both end surfaces of the piston 18. The cushion dampers 72*a*, 72*b* include holes 78, which penetrate along the axial direction substantially in the center thereof, base members 80 that are inserted respectively into the damper grooves 70*a*, 70*b*, and guide members 82 that are expanded in width with respect to the base members 80, and which are inserted respectively into the second grooves 76 of the damper grooves 70*a*, 70*b*.

Further, the cushion dampers 72*a*, 72*b* are formed with cross sectional shapes that are substantially the same as the cross sectional shapes of the damper grooves 70*a*, 70*b*, such that the guide members 82 are inserted into the second grooves 76, whereas the base members 80 are inserted into the first grooves 74 and project outwardly, respectively, a given length with respect to both end surfaces of the piston 18.

Furthermore, the lengthwise dimension of the cushion dampers 72*a*, 72*b* is set substantially equal to the lengthwise dimension of the damper grooves 70*a*, 70*b*. Owing thereto, when the cushion dampers 72*a*, 72*b* are installed in the damper grooves 70*a*, 70*b*, the end surfaces of the cushion dampers 72*a*, 72*b* do not project outwardly from the planar surface sections 50 of the piston 18, and the holes 78 thereof are disposed so as to face the piston hole 60 of the piston 18. In addition, the piston rod 44 is inserted through the hole 78 of the cushion damper 72*b* that is disposed in the piston 18 on the side of the rod cover 16 (in the direction of the arrow B). The damper grooves 70*a*, 70*b* are covered completely by the cushion dampers 72*a*, 72*b*, as a result of installing the cushion dampers 72*a*, 72*b* therein.

In this manner, concerning the cushion dampers 72*a*, 72*b*, because the guide members 82, which are expanded in width with respect to the base members 80, engage with the second grooves 76 of the damper grooves 70*a*, 70*b*, relative displacements of the cushion dampers 72*a*, 72*b* in the axial direction with respect to the piston 18 are regulated. Stated otherwise, the cushion dampers 72*a*, 72*b* are installed while being capable of moving only in directions substantially perpendicular to the axis of the piston 18, along which the damper grooves 70*a*, 70*b* extend.

In addition, the cushion dampers 72*a*, 72*b* abut respectively against the head cover 14 and the rod cover 16 before the end surface of the piston 18 does, at the displacement terminal end positions of the piston 18 upon displacement of the piston 18 along the cylinder tube 12. Owing thereto, shocks are appropriately buffered and absorbed by the cushion dampers 72*a*, 72*b* when the piston 18 abuts against the head cover 14 and the rod cover 16, and the impact of such shocks on the piston 18 is prevented.

Stated otherwise, the cushion dampers 72*a*, 72*b* function as buffering mechanisms, capable of absorbing and buffering the impact of shocks to the piston 18.

The piston rod 44 is formed from a shaft having a predetermined length along the axial direction. A connecting portion 62 that is radially reduced in diameter is formed on one end thereof, which is connected to the piston 18. The connecting portion 62 is inserted through the second hole 66 and the tapered hole 68 of the piston hole 60. On the other hand, the other end of the piston rod 44 is inserted through the rod hole 42 and is supported displaceably by the bush 48 and the rod packing 46.

Further, concerning the piston rod 44, the boundary region thereof with the connecting portion 62 engages with a stepped portion between the first hole 64 and the second hole 66, whereby the piston rod 44 is positioned with respect to the piston 18.

Furthermore, by pressing the end of the connecting portion 62, which is inserted into the tapered hole 68, toward the side of the second hole 66 (in the direction of the arrow B), the end portion thereof is plastically deformed along the tapered hole 68 and is expanded in diameter. As a result, the connecting portion 62 is caulked onto the tapered hole 68 of the piston 18 through the deformed end portion thereof, thereby connecting the piston rod 44 and the piston 18 together. Further, the connecting portion 62 of the piston rod 44 does not project beyond the end surface of the piston 18, and is caulked in such a way that it forms substantially the same surface with the end surface of the piston 18.

Figure 8:
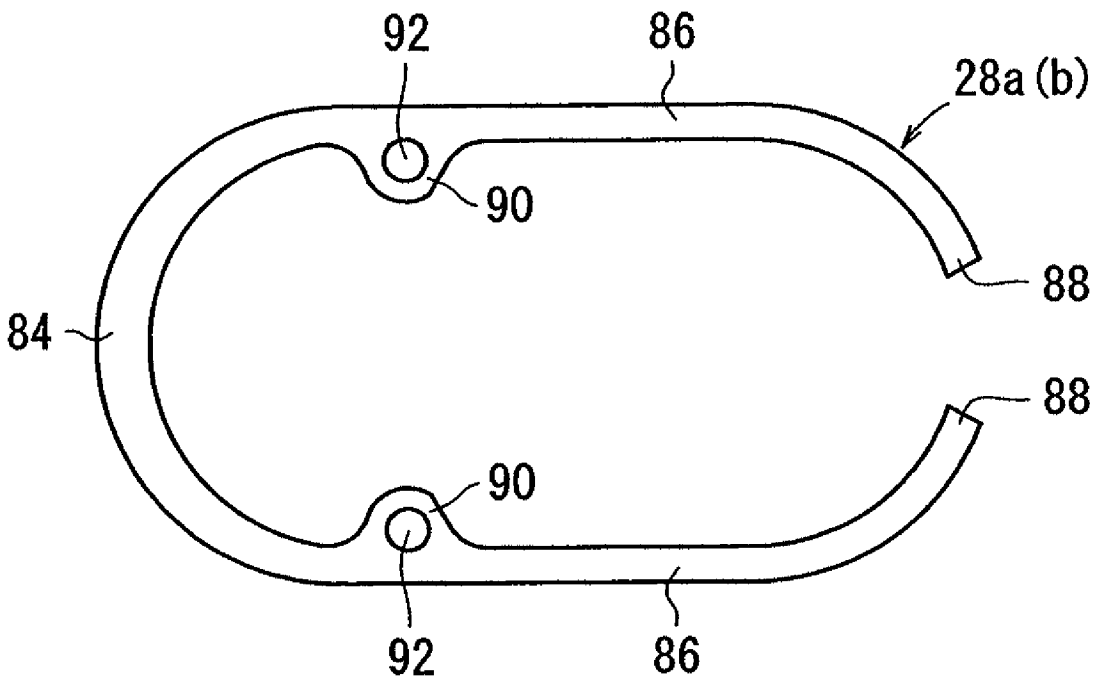
FIG. 8 is a simple plan view of a locking ring shown in FIG. 2.

Locking rings 28*a*, 28*b* are formed with substantially U-shaped cross sections from a metallic material as shown in FIG. 8, and are installed respectively into a pair of ring grooves 26, which are formed in the cylinder hole 20 of the cylinder tube 12.

The locking rings 28*a*, 28*b* are formed with shapes corresponding to the ring grooves 26, and include a bent section 84, which is bent at a predetermined radius of curvature, a pair of arm sections 86 that extend in substantially straight lines from both ends of the bent section 84, and a pair of claw sections 88 disposed on ends of the arm sections 86, which are bent at a predetermined radius of curvature and are mutually separated a predetermined distance from each other. The claw sections 88 are positioned in confronting relation to the bent section 84 sandwiching the arm sections 86 therebetween, and the locking rings 28*a*, 28*b* possess a certain elasticity, which urges the pair of claw sections 88 themselves mutually in directions to separate a predetermined distance away from each other.

The bent section 84 is formed with a predetermined radius of curvature corresponding to both side portions of the cylinder hole 20, whereas the claw sections 88, similarly, are formed with a predetermined radius of curvature that corresponds to the side portions of the cylinder hole 20.

Bulging portions 90, which bulge toward the inner side surface in a mutually facing relation to each other, are included on the arm sections 86. Jig holes 92 are formed respectively in the bulging portions 90. Specifically, the bulging portions 90 and the jig holes 92 are disposed at positions on the arm sections 86 coinciding with sides of the bent section 84. In addition, by inserting an unillustrated jig into the pair of jig holes 92 and displacing the bulging portions 90 along with the jig holes 92 mutually in directions to approach one another, the arm sections 86 and the claw sections 88 can be elastically deformed so as to approach mutually toward each other about the junctures at the bent section 84.

Specifically, the bent section 84 and the claw sections 88 of the locking rings 28*a*, 28*b*, are made to engage with both side portions of the cylinder hole 20 in the ring grooves 26.

In addition, the locking rings 28*a*, 28*b* are installed respectively into the ring grooves 26 after the head cover 14 and the rod cover 16 have been installed with respect to the cylinder hole 20 of the cylinder tube 12. Accordingly, the head cover 14 and the rod cover 16 are fixed by means of the projections 38*a*, 38*b* thereof and the locking rings 28*a*, 28*b*. At this time, the head cover 14 and the rod cover 16 do not protrude from the end surfaces of the cylinder tube 12.

The fluid pressure cylinder 10 according to the present invention is basically constructed as described above. Next, an explanation shall be given concerning assembly of the fluid pressure cylinder 10.

First, when the cushion dampers 72*a*, 72*b* are installed onto the piston 18, the guide members 82 of the cushion dampers

72*a*, 72*b* are arranged on respective sides of the piston 18, and the cushion dampers 72*a*, 72*b* are disposed in the end sides of the opened damper grooves 70*a*, 70*b*.

Additionally, the cushion dampers 72*a*, 72*b* are slidably displaced toward the piston 18 to insert the guide members 82 into the second grooves 76. Specifically, the cushion dampers 72*a*, 72*b* are displaced along the damper grooves 70*a*, 70*b* in directions substantially perpendicular to the axis of the piston 18. Owing thereto, the cushion dampers 72*a*, 72*b* that make up the guide members 82 are inserted into the second grooves 76, and along therewith, the base members 80 thereof are inserted into the first grooves 74.

Next, installation of the cushion dampers 72*a*, 72*b* is completed when the end portions of the cushion dampers 72*a*, 72*b* are moved into agreement and become flush with the planar surface sections 50 of the piston 18. In this case, the holes 78 of the cushion dampers 72*a*, 72*b* are positioned coaxially with the piston hole 60 of the piston 18, and the cushion dampers 72*a*, 72*b* protrude, at a predetermined height, with respect to both end surfaces of the piston 18 (see FIG. 3).

In this manner, by slidably displacing the cushion dampers 72*a*, 72*b* in directions substantially perpendicular to the axis of the piston 18 with respect to the damper grooves 70*a*, 70*b* provided on both end surfaces of the piston 18, the cushion dampers 72*a*, 72*b* can be installed easily. In addition, because the guide members 82 engage within the second grooves 76, the cushion dampers 72*a*, 72*b* are not displaceable in axial directions with respect to the piston 18.

Further, although the cushion dampers 72*a*, 72*b* are displaceable in directions substantially perpendicular to the axis of the piston 18, upon insertion of the piston 18 into the cylinder hole 20 of the cylinder tube 12, the outer circumferential surface of the piston 18 becomes surrounded by the inner circumferential surface of the cylinder hole 20. Owing thereto, displacement of the cushion dampers 72*a*, 72*b* in directions substantially perpendicular to the axis of the piston 18 also is regulated.

As a result, the cushion dampers 72*a*, 72*b* normally are displaced integrally and in unison with displacement of the piston 18, thereby enabling shocks imparted to the piston 18 at the displacement terminal end positions of the piston 18 to be reliably and suitably buffered.

Next, explanations shall be made concerning the case in which the piston 18, with the pair of cushion dampers 72*a*, 72*b* installed thereon, is inserted into the cylinder tube 12, and then the head cover 14 and the rod cover 16 are assembled onto both ends of the cylinder tube 12.

First, the head cover 14 is inserted through the cylinder hole 20 from one end side of the cylinder tube 12, and is pressed into the interior of the cylinder hole 20 toward the piston 18 (in the direction of the arrow B), until the projections 38*a* thereof abut against the stepped portion 24 of the recesses 22*a* disposed in the cylinder hole 20. Further, after the projections 38*a* abut against the stepped portion 24 and displacement of the head cover 14 toward the other end side of the cylinder tube 12 that forms the piston 18 side thereof (in the direction of the arrow B) is regulated, the locking ring 28a is inserted into the cylinder hole 20 and is installed in the ring groove 26 from the one end side of the cylinder tube 12.

In this case, the arm sections 86 and the claw sections 88 are deformed in directions so as to approach one another by the jig (not shown), which is inserted into the pair of jig holes 92, and after the locking ring 28*a* has been inserted up to a position alongside the ring groove 26, the locking ring 28*a* is deformed again by releasing the held state of the arm sections 86 by the jig, whereupon due to its elasticity the locking ring 28*a* expands radially outward and engages within the ring groove 26.

Accordingly, displacement of the head cover 14 toward the inside of the cylinder tube 12 (in the direction of the arrow B) is regulated in the axial direction by engagement of the projections 38*a* of the head cover 14 within the recesses 22*a* of the cylinder hole 20. Moreover, displacement of the head cover 14 outside of the cylinder tube 12 (in the direction of the arrow A) also is regulated by the locking ring 28*a* installed within the ring groove 26. That is, the head cover 14 becomes fixed into one end side of the cylinder tube 12, and is accommodated therein without protruding outwardly from the one end of the cylinder tube 12.

On the other hand, the rod cover 16 is inserted through the cylinder hole 20 from the other end side of the cylinder tube 12, and the piston rod 44 is inserted through the rod hole 42, while the rod cover 16 is pressed into the interior of the cylinder hole 20 toward the piston 18 (in the direction of the arrow A), until the projections 38*b* thereof abut against the stepped portion 24 of the recesses 22*b* disposed in the cylinder hole 20. In addition, after the projections 38*b* abut against the stepped portion 24 of the recess 22*b* and displacement of the rod cover 16 toward the one end side of the cylinder tube 12 that forms a piston 18 side thereof (in the direction of the arrow A) is regulated, the locking ring 28*b* is inserted into the cylinder hole 20 and is installed in the ring groove 26 from the other end side of the cylinder tube 12.

In this case, the arm sections 86 and the claw sections 88 are deformed in directions so as to approach one another by the jig (not shown), which is inserted into the pair of jig holes 92, and after the locking ring 28*b* has been inserted up to a position alongside the ring groove 26, the locking ring 28*b* is deformed again by releasing the held state of the arm sections 86 by the jig, whereupon due to its elasticity the locking ring 28*b* expands radially outward and engages within the ring groove 26.

Accordingly, displacement of the rod cover 16 toward the inside of the cylinder tube 12 (in the direction of the arrow A) is regulated in the axial direction by engagement of the projections 38*b* of the rod cover 16 within the recesses 22*b* of the cylinder hole 20. Moreover, displacement of the rod cover 16 outside of the cylinder tube 12 (in the direction of the arrow B) also is regulated by the locking ring 28*b* installed within the ring groove 26. That is, the rod cover 16 becomes fixed into the other end side of the cylinder tube 12, and is accommodated therein without protruding outwardly from the other end of the cylinder tube 12.

Further, because the rod cover 16 is guided along the cylinder hole 20 by the plural guide members 49, which are disposed on the outer circumferential surface of the rod cover 16, the axis of the rod hole 42 in the rod cover 16 and the center of the cylinder hole 20 can be suitably aligned with each other, and hence the piston rod 44 that is inserted through the cylinder hole 20 can easily and reliably be inserted through the rod hole 42.

In this manner, when the head cover 14 and the rod cover 16 are installed onto both ends of the cylinder tube 12, the pairs of projections 38*a*, 38*b* are made to engage respectively within the pairs of recesses 22*a*, 22*b* provided in the cylinder hole 20 of the cylinder tube 12, and the locking rings 28*a*, 28*b*, which are inserted from ends of the cylinder hole 20, are made to engage within the ring grooves 26. Owing thereto, displacements of the head cover 14 and the rod cover 16 in axial directions can easily and reliably be regulated.

Next, explanations shall be given concerning operations and effects of the fluid pressure cylinder 10, which has been assembled in the foregoing manner. Such explanations shall be made assuming the state shown in FIG. 3, in which the piston 18 is displaced toward the side of the head cover 14 (in the direction of the arrow A), is taken as an initial position.

First, pressure fluid from an unillustrated pressure fluid supply source is introduced into the first fluid port 30. In this case, the second port 32 is placed in a state of being open to atmosphere, under a switching action of an unillustrated directional control valve. As a result, the pressure fluid is introduced to the interior of the cylinder hole 20 from the first fluid port 30 through the communication passage 34, whereupon the piston 18 is pressed toward the side of the rod cover 16 (in the direction of the arrow B) by the pressure fluid introduced between the head cover 14 and the piston 18. Additionally, by abutment of the cushion damper 72*b* installed at the end surface of the piston 18 against the end surface of the rod cover 16, the displacement of the piston 18 reaches the regulated displacement terminal end position thereof. At this time, shocks generated upon abutment are buffered by the cushion damper 72*b*, and such shocks are prevented from exerting an impact on the piston 18.

On the other hand, in the event that the piston 18 is displaced in the opposite direction (in the direction of the arrow A), pressure fluid is supplied to the second fluid port 32, while the first fluid port 30 is placed in a state of being open to atmosphere, under a switching action of the directional control valve (not shown). The pressure fluid is introduced to the interior of the cylinder hole 20 from the second fluid port 32 through the communication passage 34, whereupon the piston 18 is pressed toward the side of the head cover 14 (in the direction of the arrow A) by the pressure fluid introduced between the rod cover 16 and the piston 18. Additionally, upon displacement of the piston 18, the piston rod 44 and the cushion damper 72*a* are displaced integrally toward the side of the head cover 14, and by abutment of the cushion damper 72*a* that confronts the head cover 14 against the end surface of the head cover 14, the piston 18 returns to the initial position in which the displacement of the piston 18 is regulated. At this time, similarly, shocks generated upon abutment are buffered by the cushion damper 72*a*, and such shocks are prevented from exerting an impact on the piston 18.

In the above manner, with the present embodiment, the projections 38*a*, 38*b* are disposed at both side portions on the head cover 14 and the rod cover 16, and pairs of recesses 22*a*, 22*b* are provided in the cylinder hole 20 of the cylinder tube 12, whereby displacements of the head cover 14 and the rod cover 16 along the axial direction can be regulated. Owing thereto, because only partial processing of the projections 38*a*, 38*b* on the head cover 14 and the rod cover 16 is required, and since processing only of the recesses 22*a*, 22*b* may be performed on the cylinder tube 12, compared to the conventional fluid pressure cylinder, in which processing was performed around the entire periphery of the gasket and the piston hole, processing costs can be reduced considerably.

In this manner, when the head cover 14 and the rod cover 16 are fixed with respect to the cylinder tube 12, since only partial processing is carried out with respect to the cylinder hole 20 of the cylinder tube 12 and the outer circumferential surfaces of the head cover 14 and the rod cover 16, processing costs for the cylinder tube 12, the head cover 14 and the rod cover 16 are reduced, thereby enabling the fluid pressure cylinder 10 to be manufactured at low cost.

Further, when the head cover 14 and the rod cover 16 are assembled onto the cylinder tube 12, since the head cover 14 and the rod cover 16 can be reliably positioned, ease of assembly with respect to the cylinder tube 12 can be facilitated. Together therewith, since the head cover 14 and the rod cover 16 cannot be mistakenly inserted excessively into the interior of the cylinder tube 12, blockage of the first and second fluid ports 30, 32 by the head cover 14 and the rod cover 16 can also be prevented.

Furthermore, since the head cover 14 and the rod cover 16 can be installed in a state in which they are accommodated inside the cylinder tube 12, the longitudinal dimension of the fluid pressure cylinder 10, including the cylinder tube 12 thereof, can be suppressed. Compared to the conventional fluid pressure cylinder, in which a head cover and a rod cover are installed by a plurality of bolts with respect to both ends of a cylinder body, the fluid pressure cylinder 10 of the present invention can be made smaller in size. Stated otherwise, the head cover 14 and the rod cover 16, which are installed into both ends of the cylinder tube 12, do not protrude from either of the ends.

Still further, ring grooves 26 are provided in the cylinder hole 20, and the locking rings 28*a*, 28*b* are installed into the ring grooves 26, so that the head cover 14 and the rod cover 16 can be fixed, and detachment and falling out of the head cover 14 and the rod cover 16 with respect to the cylinder tube 12 can easily and reliably be prevented.

The locking rings 28*a*, 28*b* that lock the head cover 14 and the rod cover 16 with respect to the cylinder tube 12 are not limited to the above-described configuration, including the bulging portions 90 and the jig holes 92 located at an intermediate position on the pair of arm sections 86 thereof.

For example, locking rings 100*a*, 100*b*, such as those shown in FIGS. 9 to 12, which include jig holes 104 provided respectively on both ends of the arm sections 102, may also be adopted.

Figure 9:
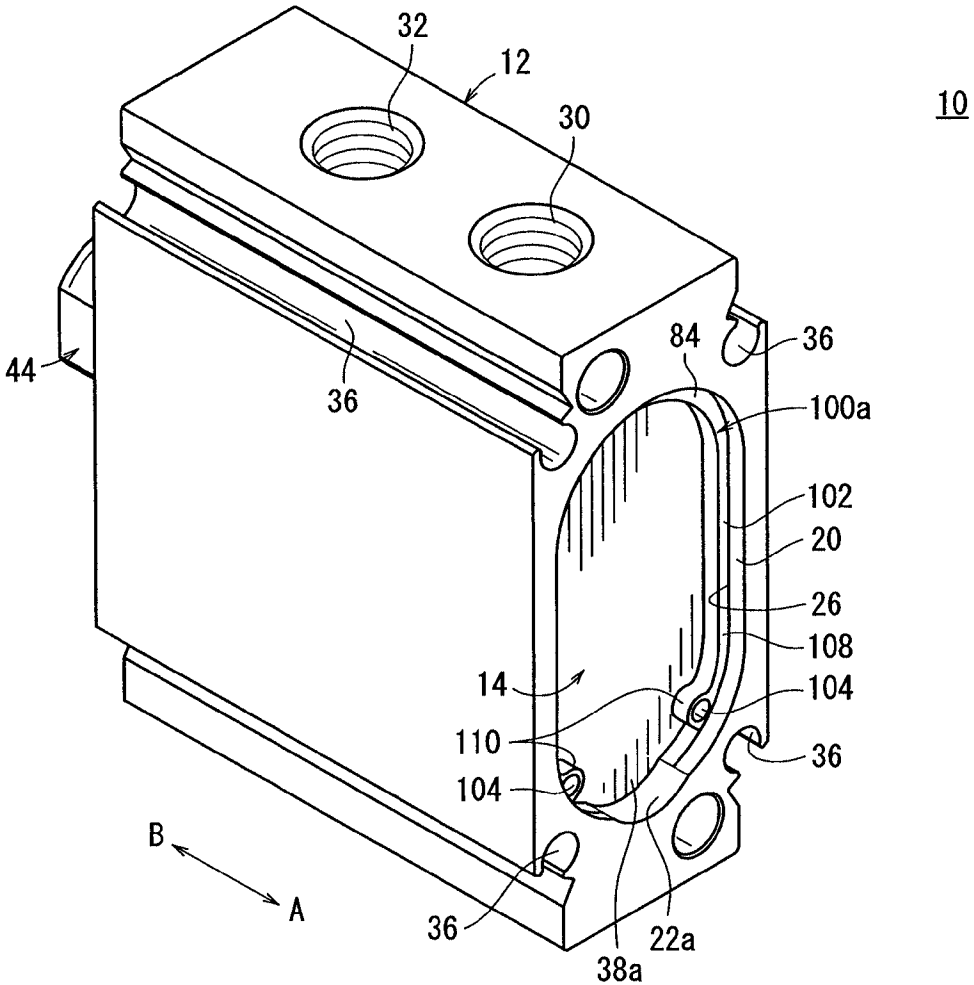
FIG. 9 is an exterior perspective view showing a state in which a locking ring is installed in the fluid pressure cylinder, according to a modified example.
Figure 10:
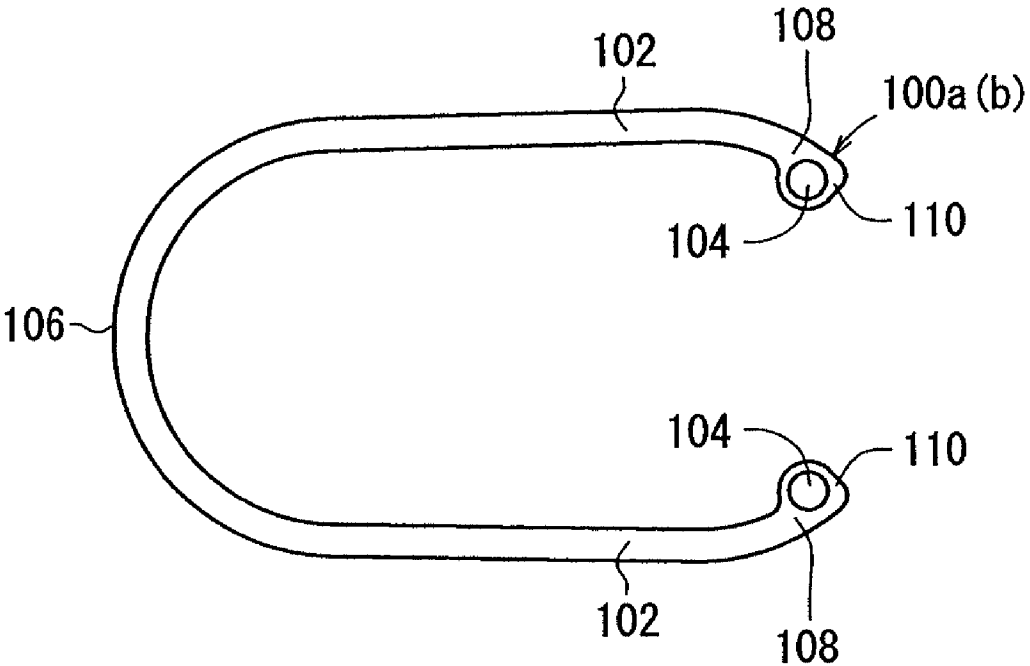
FIG. 10 is a simple plan view of the locking ring shown in FIG. 9.
Figure 11:
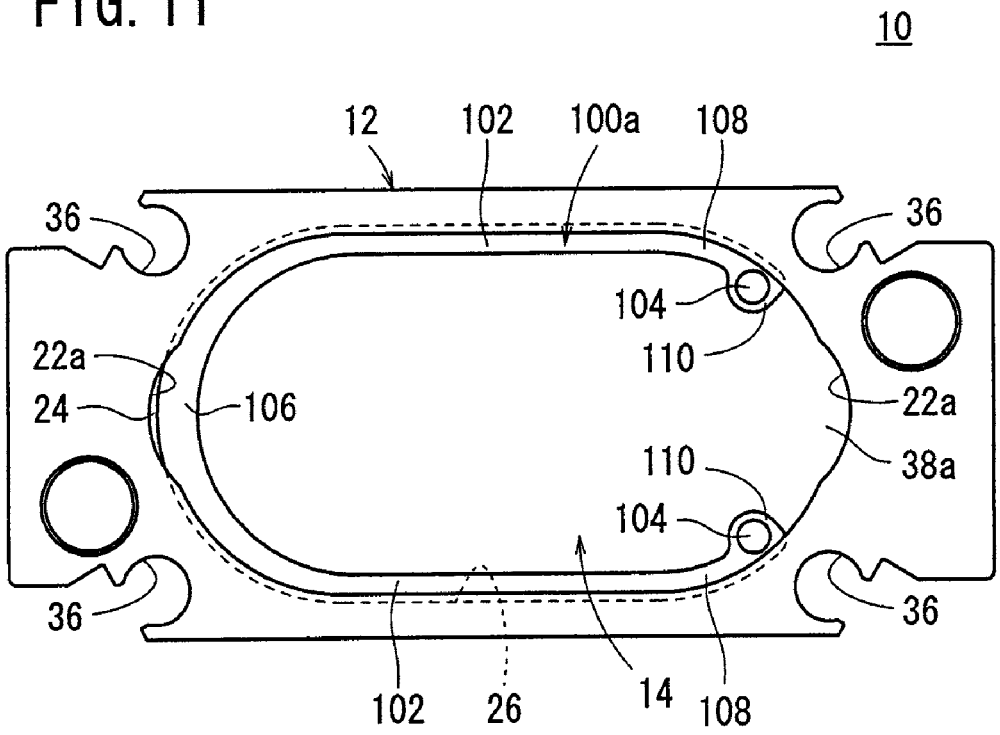
FIG. 11 is a side surface view, as viewed from the head cover side of the fluid pressure cylinder shown in FIG. 9.
Figure 12:
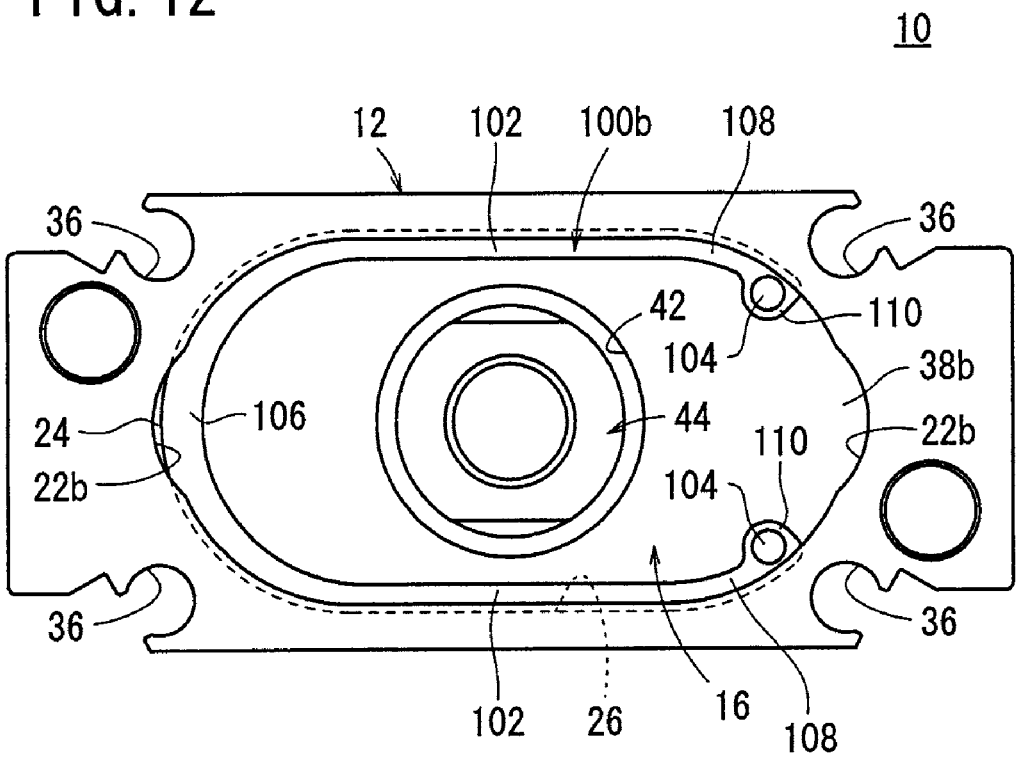
FIG. 12 is a side surface view, as viewed from a rod cover side of the fluid pressure cylinder shown in FIG. 9.

Such locking rings 100*a*, 100*b*, as shown in FIGS. 9 to 12, are formed with substantially U-shaped cross sections from a metallic material, and are installed respectively into a pair of ring grooves 26, which are formed in the cylinder hole 20 of the cylinder tube 12 (see FIG. 9).

The locking rings 100*a*, 100*b* are formed with shapes corresponding to the ring grooves 26, and include a bent section 106, which is bent at a predetermined radius of curvature, a pair of arm sections 102 that extend in substantially straight lines from both ends of the bent section 106, and a pair of claw sections 108 disposed on ends of the arm sections 102, which are bent at a predetermined radius of curvature and are mutually separated a predetermined distance from each other. The claw sections 108 are positioned in confronting relation to the bent section 106 sandwiching the arm sections 102 therebetween, and the locking rings 100*a*, 100*b* possess a certain elasticity, which urges the pair of claw sections 108 themselves mutually in directions to separate a predetermined distance away from each other. The bent section 106 has the same structure as the bent section 84 constituting the locking rings 28*a*, 28*b*, and thus detailed explanations of this feature are omitted.

The claw sections 108 include bulging portions 110, which face each other and bulge on inner side surfaces of the claw sections 108. Jig holes 104 are formed respectively in each of the bulging portions 110. In addition, by inserting an unillustrated jig into the pair of jig holes 104 and displacing the bulging portions 110 along with the jig holes 104 mutually in directions to approach one another, the arm sections 102 and the claw sections 108 can be elastically deformed so as to approach mutually toward each other about the junctures at the bent section 106.

In addition, the locking rings 100*a*, 100*b* are installed respectively into the ring grooves 26 after the head cover 14 and the rod cover 16 have been installed with respect to the cylinder hole 20 of the cylinder tube 12. Accordingly, the head cover 14 and the rod cover 16 are fixed by means of the projections 38*a*, 38*b* thereof and the locking rings 100*a*, 100*b*. At this time, the head cover 14 and the rod cover 16 do not protrude from the end surfaces of the cylinder tube 12.

The fluid pressure cylinder 10 according to the present invention is not limited to the aforementioned embodiments, and naturally various other configurations may be adopted without departing from the essential features and gist of the present invention.

What is claimed is:

1. A fluid pressure cylinder comprising:

a tubular cylinder body having a cylinder chamber, which is elliptically shaped in cross section;

a piston formed with an elliptical shape in cross section corresponding to said cylinder chamber, said piston being disposed displaceably along an axial direction inside of said cylinder chamber; and a pair of cover members accommodated inside of said cylinder chamber and closing said cylinder chamber, and having arcuate shaped first projections on an outer circumferential surface thereof that project toward an inner wall surface of said cylinder chamber, said first projections being arranged as a pair, in symmetrical positions centrally about an axis of said cover members, and bulging outwardly on an outer circumferential surface of said cover members, wherein a pair of recesses are formed on said cylinder chamber, which are recessed with respect to the cross sectional elliptically shaped inner wall surface thereof, said first projections being inserted into said recesses and retained therein against movement in the axial direction of said cylinder chamber, and wherein said recesses are recessed in arcuate shapes corresponding to said first projections, in directions away from the center of said cylinder chamber, and a radius of curvature of said recesses is set to be smaller than a radius of curvature on respective end portions of said cylinder chamber.

2. The fluid pressure cylinder according to claim 1, wherein locking members are installed into installation grooves formed along said inner circumferential surface in said cylinder chamber, and displacement of said cover members in the axial direction is regulated by said recesses and said locking members.

3. The fluid pressure cylinder according to claim 2, wherein a second projection, which abuts against an inner wall surface of said cylinder chamber, is disposed on said outer circumferential surface of one of said cover members.

4. The fluid pressure cylinder according to claim 3, wherein said second projection comprises a plurality of projections disposed along said outer circumferential surface.

5. A fluid pressure cylinder comprising:

a tubular cylinder body having a cylinder chamber, which is elliptically shaped in cross section;

a piston formed with an elliptical shape in cross section corresponding to said cylinder chamber, said piston being disposed displaceably along an axial direction inside of said cylinder chamber; and a pair of cover members accommodated inside of said cylinder chamber and closing said cylinder chamber, and having first projections on an outer circumferential surface thereof that project toward an inner wall surface of said cylinder chamber, wherein recesses are formed on said cylinder chamber, which are recessed with respect to the cross sectional elliptically shaped inner wall surface thereof, said first projections being inserted into said recesses and retained therein against movement in the axial direction of said cylinder chamber, and wherein a plurality of second projections, which abut against an inner wall surface of said cylinder chamber, are disposed along the outer circumferential surface of one of said cover members.

6. The fluid pressure cylinder according to claim 5, wherein said first projections are arranged as a pair, in symmetrical positions centrally about an axis of said cover members, and bulging outwardly on an outer circumferential surface of said cover members.

7. The fluid pressure cylinder according to claim 6, wherein said recesses are recessed in arcuate shapes corresponding to said first projections, in directions away from the center of said cylinder chamber.

8. The fluid pressure cylinder according to claim 7, wherein locking members are installed into installation grooves formed along said inner circumferential surface in said cylinder chamber, and displacement of said cover members in the axial direction is regulated by said recesses and said locking members.

* * * * *